US005898380A

United States Patent [19]

Chi

[11] Patent Number: 5,898,380

[45] Date of Patent: Apr. 27, 1999

[54] SHOCK ENDURABLE ALARM LAMP

[76] Inventor: Yu-Tsang Chi, No. 65, Ho Ping Road, Lu Chou Country, Taipei Hsien, Taiwan

[21] Appl. No.: 08/891,295

[22] Filed: Jul. 10, 1997

[51] Int. Cl.[6] ..... G08B 3/00

[52] U.S. Cl. ..... 340/691; 340/321; 362/390

[58] Field of Search ..... 340/691, 321, 340/679, 683, 693; 362/390, 249

[56] References Cited

U.S. PATENT DOCUMENTS

| | | | |
|---|---|---|---|
| 1,802,589 | 4/1931 | Thompson | 362/390 |
| 1,905,471 | 4/1933 | Kent et al. | 362/390 |
| 3,818,428 | 6/1974 | Phipps et al. | 340/321 |
| 4,430,693 | 2/1984 | Hamacher | 362/390 |
| 4,954,936 | 9/1990 | Kawabata et al. | 362/390 |
| 5,103,215 | 4/1992 | Taylor et al. | 340/691 |
| 5,697,695 | 12/1997 | Lin et al. | 340/321 |

*Primary Examiner*—Jeffrey A. Hofsass
*Assistant Examiner*—John Tweel, Jr.
*Attorney, Agent, or Firm*—Rosenberg, Klein & Bilker

[57] ABSTRACT

The present invention is related to a shock endurable alarm lamp which is comprised of a light emitting structure and a shock proof structure. The light emitting structure is constructed from a plurality of lampshades and lamp base structures. A shock proof structure is installed on the bottom of the light emitting structure. The shock proof structure has two layers of spring structures installed on the upper and lower sides of a fixing base, and then a bolt is inserted downwards into the two layer structures for aligning the springs. Finally, a bushing covers the outside of the structure. Therefore, a shock proof structure is formed. Next, the whole structure is installed on a machine which needs an alarm lamp. The shock proof structure formed by the two sets of springs will cause oscillations induced from the machine to be absorbed, thereby sustaining the structure and stability of the alarm lamp.

1 Claim, 6 Drawing Sheets

SHOCK ENDURABLE ALARM LAMP

BACKGROUND OF THE INVENTION

1. Field of the Invention

The present invention is related to a shock endurable alarm lamp which is mainly installed on a finishing machine for alerting the operator, the shock endurable alarm lamp is comprised of a light emitted structure and a shock proof structure, said light emitted structure may be formed from a generally used lamp or a light emitted diode (LED), and the bottom of this light emitted structure is installed with a shock proof structure having a well effect of shock proof In this structure, a plurality of springs are separately installed on the upper and lower parts of the fixing base, and every two springs are aligned to each other. A bolt is penetrated through a pair of aligned two springs and then they are fixed to upper and lower fixing disks so to form two layer of good elastic shock proof structure, and then the assembled spring structure are engaged into a bush and is fixed on the nose portion of the bush, and then they are installed to a finishing machine through a pillar. By using the springs to absorb the vibration so to generate a buffer effect, thus the alarm lamp may be prevented to be destroyed by the resonance from the oscillation of finishing machine, and therefore, the lifetime of alarm lamp are prolonged.

2. Description of the Prior Art

In the field of automatic control, owing to the progress of new technology and industrialization, other then the performance of a product, the shape of the product is also a main concern for the user, now in different kinds of finishing machine, the alarm lamp is generally used, it may be used to alert the operator to pay attention to the danger in working.

As shown in FIGS. 5 and 6, in the current alarm lamp, a plurality of lamps are installed within a lamp device, after assembling, the structure are integrally installed on a finishing machine. The drawback of this design is that since the finishing machine is driven by a motor, the structure itself is assembled by different mechanic elements, thus it has no the buffer effect, naturally, a big vibration will occur, accordingly, the alarm lamp installed on said finishing machine will resonate so that the lamp device will be destroyed, therefore, the lifetime of the alarm lamp will reduce and the cost will increase.

SUMMARY OF THE INVENTION

Accordingly, in order to solve said problem, the inventor of the present invention has studies a brand-new lampshade endurable alarm lamp which is simple structured and durable.

The main object of the present invention is to provided a shock endurable alarm lamp, wherein a shock proof structure is additionally added to the bottom of a light emitted structure, by this shock proof structure, most of the vibrations inducing from a finishing machine may be absorbed, thus the lamp will not be destroyed.

A further object of the present invention is to provide a shock endurable alarm lamp, said shock proof structure is installed on the upper and lower sides of two layer springs so that the two springs are aligned, and a bolt is penetrated through said structure, then it is installed on a pillar of a finishing machine so to attain the effect of shock proof.

BRIEF DESCRIPTION OF THE DRAWINGS

The invention, as well as its many advantages, may be further understood by the following description and drawings in which.

DETAILED DESCRIPTION OF THE PREFERRED EMBODIMENT

Figure 1:
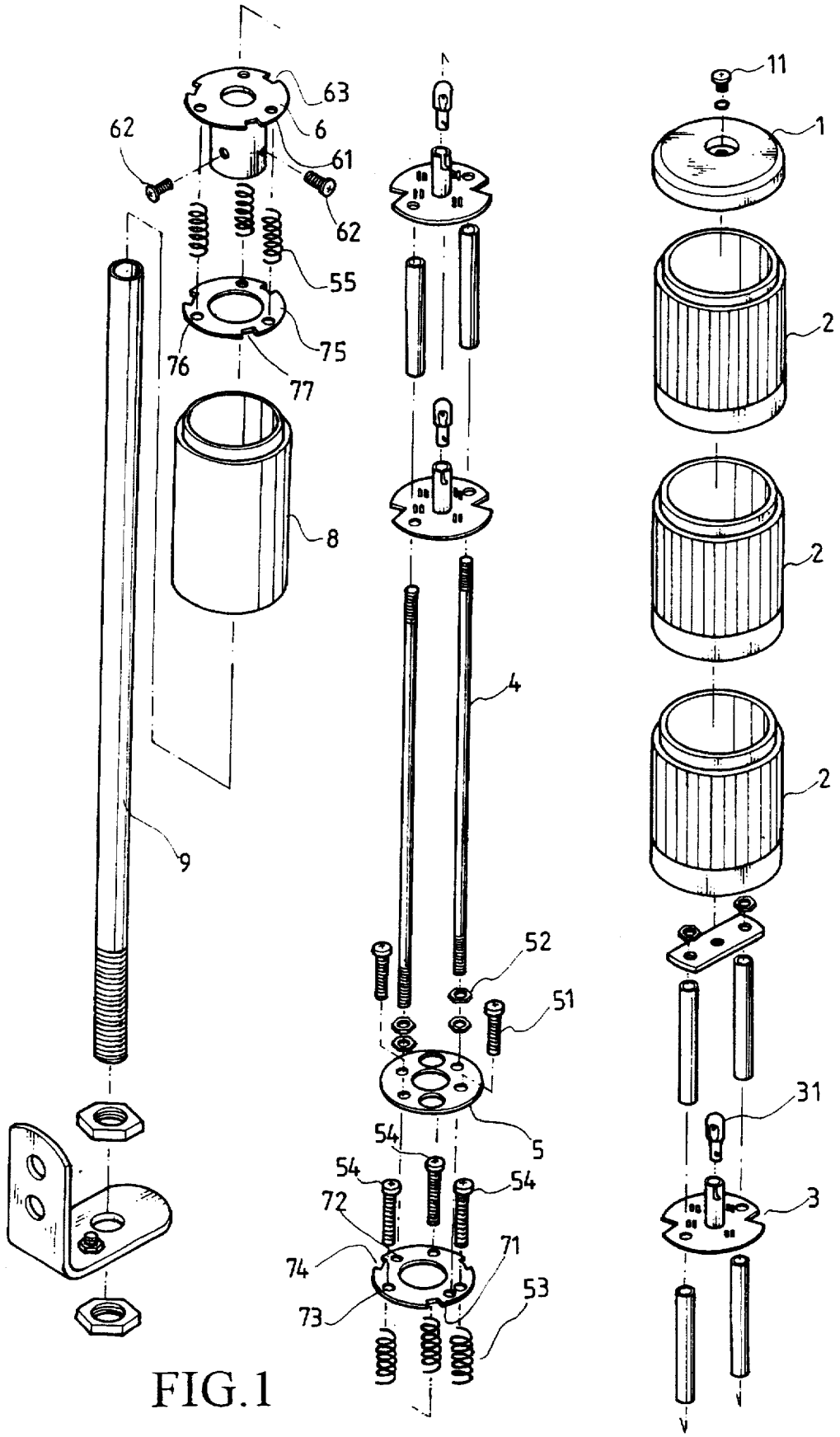
FIG. 1 is a exploded respectively view of the present invention.
Figure 2:
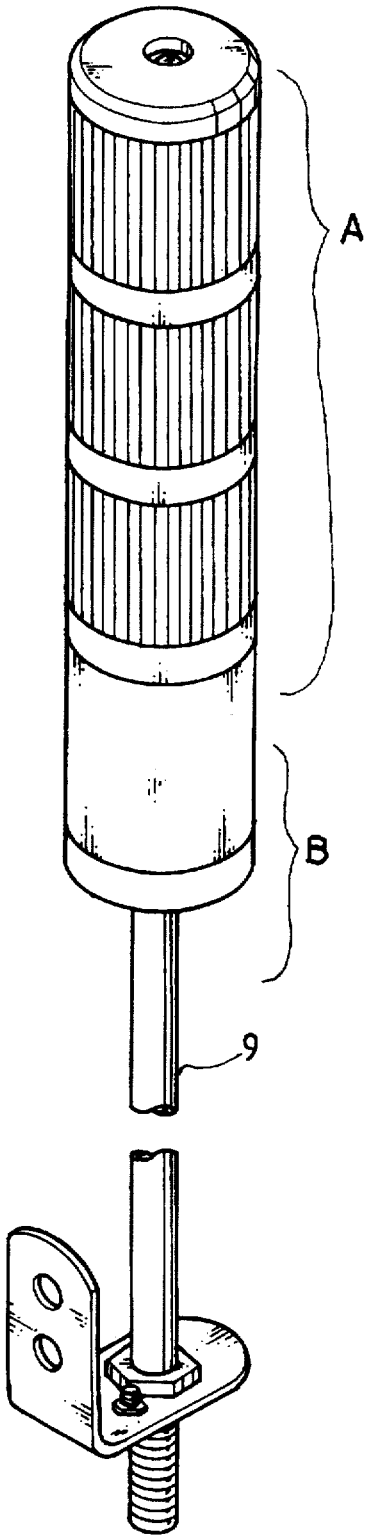
FIG. 2 is a assembly view of the present invention.

FIGS. 1 and 2 are the integral structure of the present invention, it is shown that the present invention is mainly comprised of a light emitted structure (A) and a shock proof structure (B). Said light emitted structure (A) is formed by a plurality of lampshades (2) the inner side of which is installed of a lamp (31), said lamp (31) is installed on a lamp base (3). After the lampshades have been assembled, then an upper cover (1) is attached to the top end of the lampshade (2), next bolts (4) is penetrated through the positioning bush (52) so to be fixedly lock on the buckling disk (5), another, the bolts (4) are regulated to the required length by the nut (52) on the bolts (4) so to form a complete light emitted structure (A). The number of the lamp on the light emitted structure is determined from the practical requirement (in this embodiment, for example, the number of lamp is three), and the light emitted structure thereof may be changed according to the user's requirement, ex. the lamp may be changed to LED (light emitted diode). Said buckling disk (5) has additionally two short bolts (51) for using to combine with a shock proof structure (B) which will be described in the following.

Now referring to FIG. 3, a shock proof structure (B) is installed below the light emitted structure (A), said light emitted structure is mainly comprised of an upper fixing disk (71), a fixing base (6), a plurality of spring (53), lower fixing disk (75) and bush (8).

Said upper fixing disk (71) has a circular shape, and a plurality of holes are located thereon, and the number of the holes are determined by the springs (will be described in the following), While a proper number of grooves are installed around the periphery thereof so to afterwards the structure may be easily installed into said bush (8).

A plurality of holes (61) are installed on the fixing base (6), the number of said holes (61) is the same as that of said spring as above the fixing disk (71) described hereinabove (in this embodiment, for easily describing, the number is three). A plurality of grooves are installed on the circumference of said fixing base. As said fixing disk (71), the number of the grooves is also matched with the structure of the nose portion (81) installed within said bush (8) so that it may be re-installed into said bush (8) and is buckled easily.

A plurality of springs (53) and (55)are installed on the upper and lower layers of said fixing base (6), and the springs on the upper and lower layers are aligned to each other, and further a bolt (54) is penetrated through said springs (53) and (55).

A lower fixing disk (75) is installed under the second spring (55), this lower fixing disk (75) has a shape the same as that of the upper fixing disk (71), a plurality of openings is installed, the number of which is also matched with said springs (53) and (55) (in the figure, three springs are shown). On the periphery of said opening is installed with a plurality of grooves which are matched with and having the same number as the grooves (63) of the upper fixing disk (71) and said fixing base (6).

Figure 3:
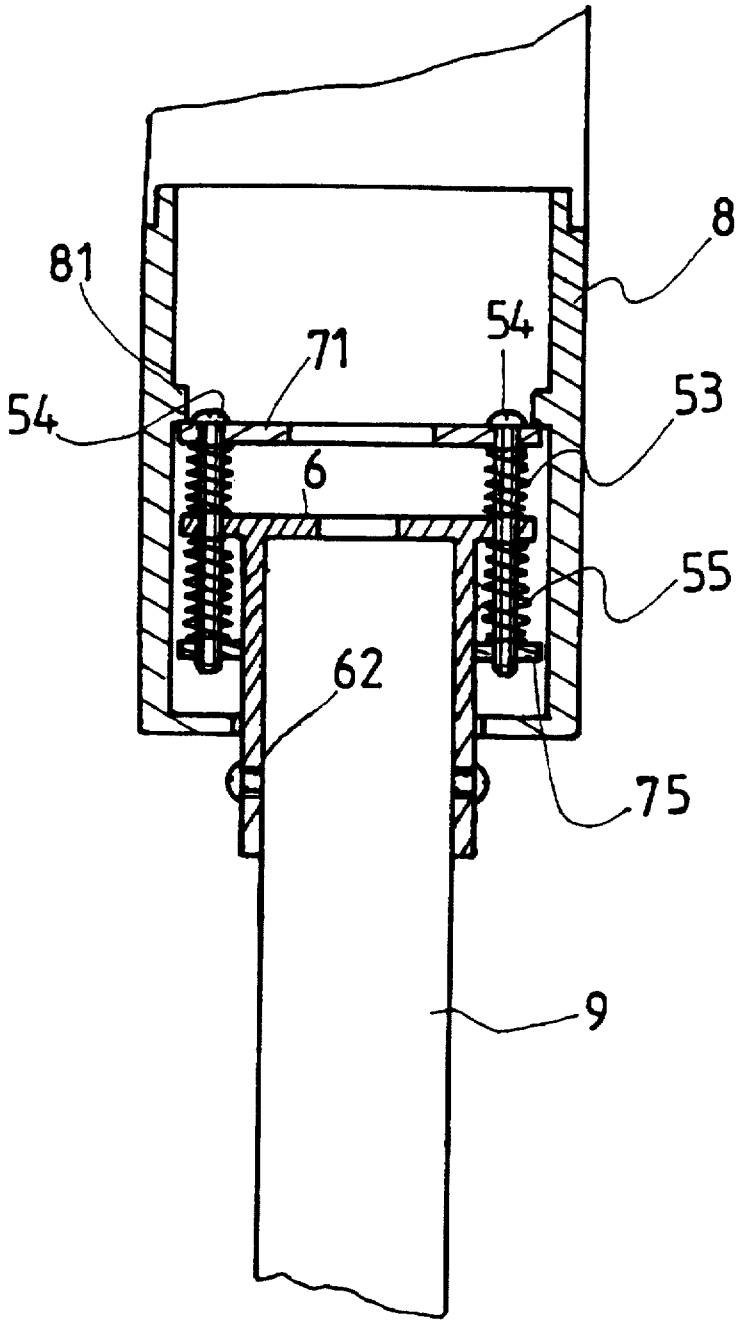
FIG. 3 is a partial cross section view of the shock proof structure of the present invention.
Figure 4:
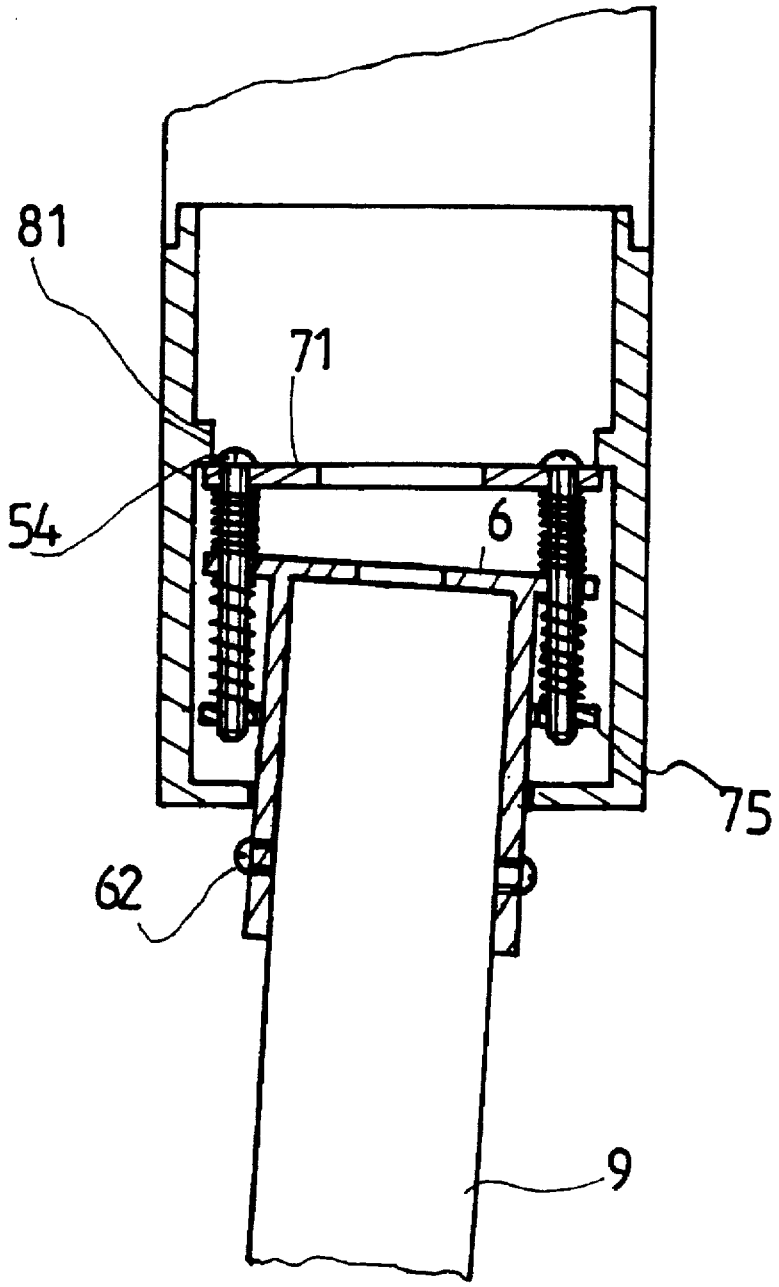
FIG. 4 is a partial cross section view about the shock of the present invention.
Figure 5:
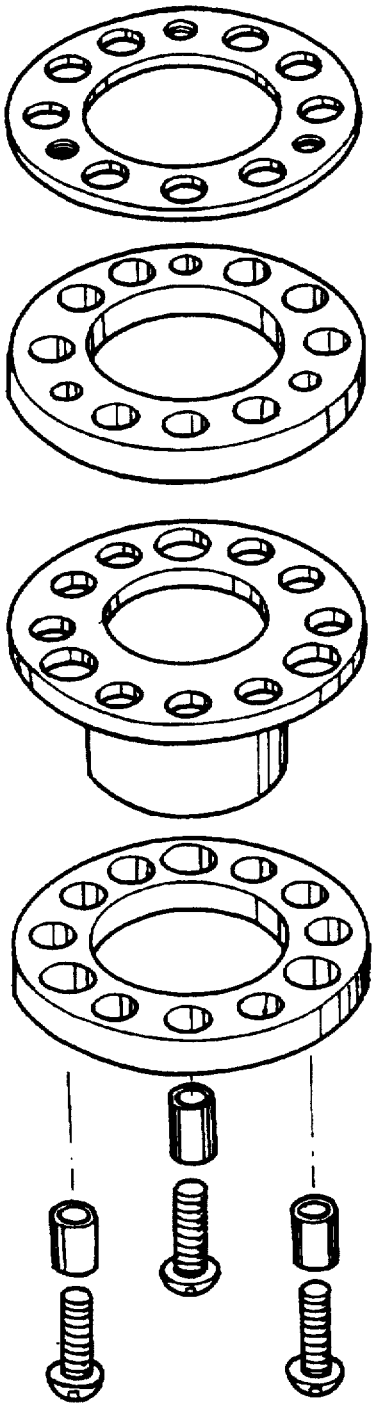
FIG. 5 is a systematic exploded view of the prior art.

As shown in FIG. 3, in assembling, said upper and lower springs (53) and (55) are aligned on the upper and lower ends of the fixing base (6), and after the upper fixing disk (71) and lower fixing disk (75) are aligned on the upper and lower sides of the spring (53), the bolt (54) is penetrated downwards through said fixing disk (71), spring (53), fixing base (6), spring (55) and lower fixing disk (75), and then it is locked on the thread hole (76) of the lower fixing disk (75), thus these components may be assembled together, the groove (63) of the fixing base (6) and the groove(74) of the lower fixing disk (75) are aligned to each other by the notches thereof, in order to be combined with the light emitted structure (A), thus the buckling disk (5) is fixed locked on the thread hole (72) of the upper fixing disk (71) by a bolt (51).

As said shock proof structure (B) is installed within said bush (8), the buckling disk (50) is positioning on the nose portion (81) as a pillar. Then the groove (74) of the upper fixing disk (71), the groove (63) of the fixing base (6) and the groove (77) of the lower fixing base (75) are slid inwards along the nose portion (81) of the bush (8). When the shock proof structure will be entered into said bush (8), since the buckling disk (5) has no groove, thus they are impossible to pass through the nose portion (81) for being buckling on the bush (8). After assembling, the fixing base (6) is properly rotated, it is designed that all the grooves will not aligned with said nose portion (81), thus they will not be dropped away.

Meanwhile, since the pillar is inserted into the opening of said fixing base (6), and is fixed by a bolt (62), thus the structure is as steady as possible so to attain the effect of combination, and then the pillar (9) is installed on the surface of a machine through a proper base.

Figure 6:
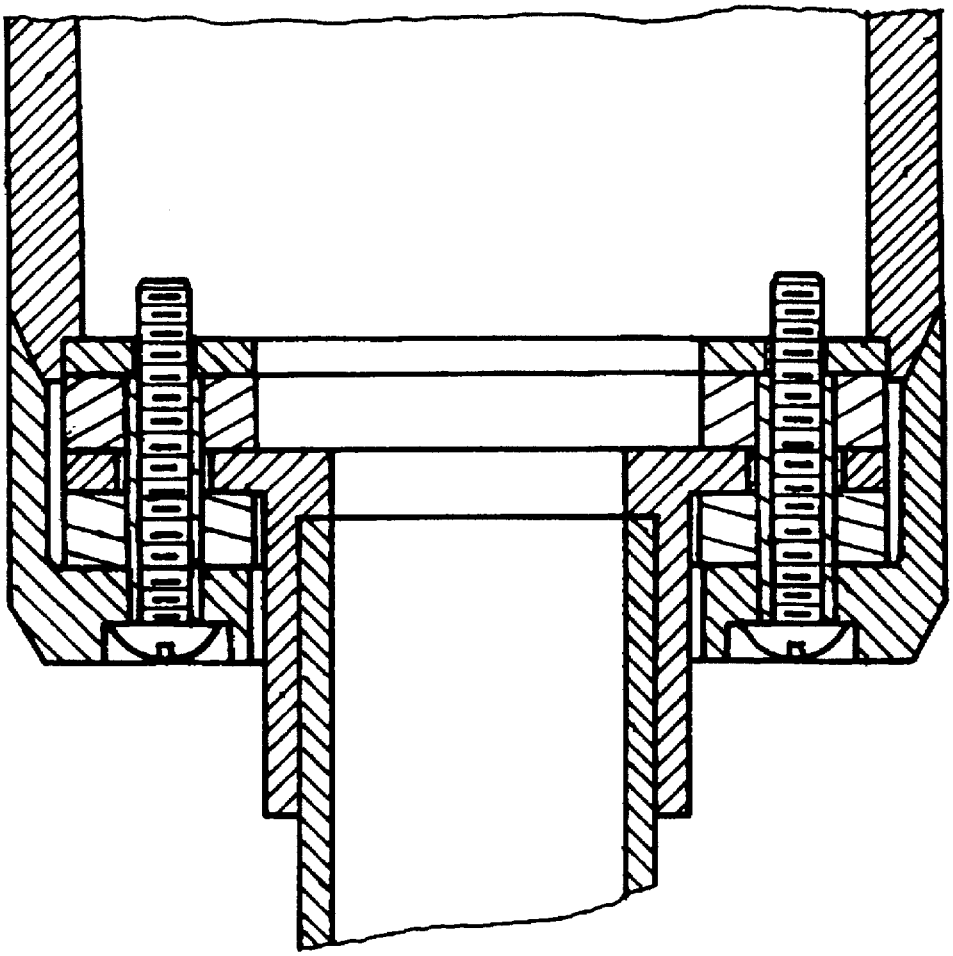
FIG. 6 is a cross section view of the prior art.

As the finishing machine is used, the machine itself will produce dramatic vibrations, and further the alarm lamp will be resonant. Now, as shown in FIG. 6, if the vibrations occur, since the effect of said springs (53) and (55), the vibration will be absorbed, even the alarm lamp has some inclination, the vibration will also be absorbed by the springs. Therefore, the shock proof effect is attained.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

DESCRIPTION FOR THE NUMBERS IN FIGS.

| | | | |
|---|---|---|---|
| A | light emitted structure | b | shock proof structure |
| 1 | upper cover | 11 | bolt |
| 2 | lampshade | 31 | lamp |
| 3 | lamp base | 31 | lamp |
| 4 | bolt | 5 | buckling disk |
| 53 | spring | 54 | bolt |
| 55 | spring | 6 | fixing base |
| 63 | groove | 71 | upper fixing disk |
| 72 | thread hole | 73 | thread hole |
| 74 | groove | 75 | lower fixing disk |
| 76 | thread hole | 77 | groove |
| 8 | bush | | |
| 81 | nose portion | 9 | pillar |

What is claimed is:

1. A shock endurable alarm, comprising:

a light emitting structure, said light emitting structure including (a) a plurality of lampshades coupled together, (b) a plurality of lamp bases respectively enclosed by said plurality of lampshades, (c) a plurality of lamps mounted on said lamp bases, (d) a pair of bolts securing said plurality of lamp bases together, and (e) a buckling disk coupled to one end of said pair of bolts; and, a shock proof structure coupled to said light emitting structure, said shock proof structure including (a) a bushing coupled to a lowermost one of said plurality of lampshades, (b) a fixing base displacably disposed in said bushing and having opposing first and second sides, said fixing base having a lower portion extending from said second side with an opening formed therein for coupling to a mounting pillar, said fixing base having a plurality of first through holes formed therein, (c) a lower fixing disk disposed within said bushing and displacably disposed on said lower portion of said fixing base, said lower fixing disk having a plurality of threaded holes formed therein and located in correspondence with said first through holes, (d) an upper fixing disk disposed in said bushing adjacent said second side of said fixing base, said upper fixing disk having a plurality of second through holes formed therein and located in correspondence with said plurality of first through holes of said fixing base, (e) a plurality of threaded fasteners respectively extending through said plurality of first and second through holes, each of said threaded fasteners having a distal end threadedly coupled to a respective one of said plurality of threaded holes, (f) a plurality of first springs disposed between said upper fixing disk and said first side of said fixing base, each of said plurality of first springs having a respective one of said plurality of threaded fasteners passing therethrough, and (g) a plurality of second springs disposed between said lower fixing disk and said second side of said fixing base, each of said plurality of second springs having a respective one of said plurality of threaded fasteners passing therethrough, wherein said light emitting structure is substantially vibrationally isolated from the mounting pillar.

* * * * *